US011458342B2

(12) United States Patent
Masselink

(10) Patent No.: US 11,458,342 B2
(45) Date of Patent: Oct. 4, 2022

(54) TRAMPOLINE

(71) Applicant: SALTA B.V., Tubbergen (NL)

(72) Inventor: Nick Gerben Masselink, Tubbergen (NL)

(73) Assignee: SALTA B.V., Tubbergen (NL)

( * ) Notice: Subject to any disclaimer, the term of this patent is extended or adjusted under 35 U.S.C. 154(b) by 0 days.

(21) Appl. No.: 16/981,539

(22) PCT Filed: Mar. 4, 2019

(86) PCT No.: PCT/NL2019/050133
§ 371 (c)(1),
(2) Date: Sep. 16, 2020

(87) PCT Pub. No.: WO2019/177456
PCT Pub. Date: Sep. 19, 2019

(65) Prior Publication Data

US 2021/0113875 A1 Apr. 22, 2021

(30) Foreign Application Priority Data

Mar. 18, 2018 (NL) ..... 2020604

(51) Int. Cl.

| | |
|---|---|
| ***A63B 5/11*** | (2006.01) |
| ***A63B 21/02*** | (2006.01) |
| ***A63B 21/04*** | (2006.01) |
| ***A63B 71/00*** | (2006.01) |

(52) U.S. Cl.
CPC ..... *A63B 5/11* (2013.01); *A63B 21/023* (2013.01); *A63B 21/0428* (2013.01); *A63B 71/0054* (2013.01); *A63B 2071/009* (2013.01)

(58) Field of Classification Search
CPC ..... A63B 5/11; A63B 21/023; A63B 21/0428; A63B 71/0054; A63B 2071/009
See application file for complete search history.

(56) References Cited

U.S. PATENT DOCUMENTS

| | | | |
|---|---|---|---|
| 5,637,057 | A | 6/1997 | Collura |
| 6,139,474 | A | 10/2000 | Gift et al. |
| 7,691,032 | B2 | 4/2010 | Bumham et al. |

(Continued)

FOREIGN PATENT DOCUMENTS

| | | |
|---|---|---|
| DE | 89 06 370 U1 | 7/1989 |
| DE | 42 21 284 A1 | 1/1994 |

(Continued)

OTHER PUBLICATIONS

International Search Report and Written Opinion for PCT Application No. PCT/NL2019/050133; dated Jun. 11, 2019; 13 pages.

*Primary Examiner* — Megan Anderson
(74) *Attorney, Agent, or Firm* — Seed IP Law Group LLP

(57) ABSTRACT

The invention provides a trampoline comprising a peripheral frame, a trampoline mat attached to said peripheral frame via a series of spring elements, and a protective mat for covering said spring elements, wherein said trampoline comprises a spacer attached to said peripheral frame above said series of spring elements and below said protective mat for holding said protective mat a spacer height above said spring elements, and an air permeable web connecting said protective mat and said trampoline mat.

10 Claims, 2 Drawing Sheets

(56) References Cited

U.S. PATENT DOCUMENTS

| | | | | |
|---|---|---|---|---|
| 8,905,898 | B2 * | 12/2014 | Chen | A63B 43/005 482/28 |
| 9,358,412 | B2 | 6/2016 | Nelson et al. | |
| 10,232,208 | B2 * | 3/2019 | Chen | A63B 71/022 |
| 10,576,321 | B2 * | 3/2020 | Solana | A63B 71/0054 |
| 10,780,334 | B2 * | 9/2020 | Nilsson | A63B 5/11 |
| 10,806,958 | B2 * | 10/2020 | Seaman | A63B 21/00072 |
| 2005/0054485 | A1 | 3/2005 | McDermott et al. | |

FOREIGN PATENT DOCUMENTS

| | | | |
|---|---|---|---|
| WO | 93/16762 | A1 | 9/1993 |
| WO | 2010/059057 | A2 | 5/2010 |
| WO | 2017/174567 | A1 | 10/2017 |

* cited by examiner

TRAMPOLINE

FIELD OF THE INVENTION

The invention relates to a trampoline.

BACKGROUND OF THE INVENTION

Various publications show improvements on paddings and other parts of trampolines.

U.S. Pat. No. 5,637,057 in its abstract describes: "A tire trampoline platform having a plurality of openings installed therein for purposes of blowing air from an inner cavity of the tire onto a person jumping on the platform. The plurality of vent openings having an additional template to partially or fully cover the vent openings of the platform for purposes of adjusting the resilience of the tire trampoline. A tier or multiple layers of tires are configured such that the tire trampoline apparatus can be used as a chair like apparatus. An additional capability of the tire trampoline is to have a riding toy installed thereon the platform for allowing children to play."

U.S. Pat. No. 7,691,032 in its abstract describes: "An in-ground trampoline system configured to provide a ground level jumping surface which consists of a trampoline, a pit, and a segmented retaining wall configured to support the walls of the pit."

U.S. Pat. No. 9,358,412 in its abstract describes: "An in-ground trampoline including a frame, trampoline mat, a plurality of springs and a protective pad. The protective pad incorporates a permeable material to allow for the passage of air through the protective pad. The in-ground trampoline system may also include a retaining wall which may comprise self-locking panels. In some embodiments, the self-locking panels may be attached to the frame of the in-ground trampoline."

US2005054485 in its abstract describes: "An in-ground trampoline and method of installation therefor, wherein a homeowner, trampoline enthusiast, athlete, gymnast, or the like, is provided with a safer, more accessible, ground level trampoline jumping surface configuration in view of conventional above-ground trampolines, and is further provided with a relatively inexpensive, easily constructed and transportable in-ground trampoline jumping surface support system in view of current in-ground trampoline methods of construction."

WO2010059057 in its abstract describes: "Trampoline padding element for a trampoline padding assembly usable on a trampoline, which trampoline padding element is adapted to cooperate with a trampoline padding cover to form said trampoline padding assembly, wherein the trampoline padding element is of a resilient material and is adapted to at least partly cover rigid and/or moving parts of the trampoline, wherein the trampoline padding element comprises a protection element, preferably provided along an outer circumferential edge of the trampoline padding element, which protection element in use is at least positioned above an upper frame, more in particular above a top rail of the upper frame, of the trampoline. The invention further relates to a trampoline padding cover and a trampoline padding assembly."

U.S. Pat. No. 6,139,474 in its abstract describes: "A safety pad for use on a trampoline is provided. Preferably, the pad includes an exposed closed cell foam upper surface and is sized and shaped to substantially cover trampoline springs holding a bouncing surface to a frame and the frame. In one embodiment the trampoline safety pads may be attached to a trampoline frame by slidably disposing the pads along a trampoline frame member. In another embodiment the pads may be attached to the frame using cords."

WO93/16762 in its abstract describes: "The trampoline (1) has a holder (5) and a braced web (6) therein, the holder being secured to a float body (2) via a support frame (7). The float body is preferably formed such that at least in the jump region it protrudes with its outer edge no further than the outer edge of the trampoline. The apparatus can thus be used without danger as a diving platform with or without a trampoline effect.

DE4221284 in its abstract describes: "The invention relates to a trampoline that has a jumping mat (2) the periphery of which is attached to the ends of springs (7) the other ends of which are fixed to the frame (1). A circular, flexible part (9) is sewn to the periphery of the jumping mat so as to point towards the frame and at least partly to cover the springs."

WO2017174567 in its abstract describes: "The present disclosure relates to a safety net (9, 49) adapted to surround a trampoline mat (3) of a trampoline (1, 47). The safety net comprises a protection portion (25) adapted to prevent a user from falling off the trampoline mat and/or from stepping outside the trampoline mat, and an attachment portion (27, 27') allowing attachment of at least one resilient member (7) to the trampoline mat through the attachment portion, the resilient member being adapted to retain the trampoline mat under tension. The safety net further comprises an edge portion (31) and a fold zone (33, 33'), adapted to be folded around an edge (17) of the trampoline mat. The edge portion and the protection portion are located on opposite sides of the fold zone. The edge portion comprises one or more extension diminishing means (35, 37, 39, 41, 43) for tightening of the edge portion. The disclosure further relates to a trampoline (1, 47) comprising such a safety net and to a method of arranging a safety net in a trampoline."

DE8906370U1 in its introduction describes: "The invention pertains to a jumping device, for instance a trampoline, having a jumping matt that is held in a frame using springs at its periphery."

SUMMARY OF THE INVENTION

A disadvantage of prior art is that bouncing force is still not always optimal. In particular with trampolines that have a bouncing surface substantially at a surface level. Furthermore, the safety of the users, in particular with respect to springs attaching a bouncing surface, can be improved.

Hence, it is an aspect of the invention to provide an improved and/or alternative trampoline, which preferably further at least partly obviates one or more of above-described drawbacks.

There is currently provided a trampoline comprising a peripheral frame, a trampoline mat attached to said peripheral frame via a series of spring elements, and a protective mat for covering said spring elements, wherein said trampoline comprises a spacer attached to said peripheral frame above said series of spring elements and below said protective mat for holding said protective mat a spacer height above said spring elements, and an air permeable web connecting said protective mat and said trampoline mat.

It was found that this provides an air channel allowing air to escape from below the trampoline, in particular in for instance in-ground trampolines. These measures may also be beneficial in other types of trampolines where air needs to pass from under the trampoline. Furthermore, the current embodiment will reduce or prevent the protective mat or safety pad from clapping or flapping. When air cannot escape easily form underneath a trampoline, this will seriously reduce the comfort and performance of the trampoline.

A trampoline can be rectangular, rectangular with rounded corners, oval, elliptic, round or circular. Thus, the peripheral frame usually has the same form.

The protective mat is often also referred to as safety pad. It prevents users from coming into contact with the spring elements.

In an embodiment, the trampoline is an in-ground trampoline.

In an embodiment, the peripheral frame extends above said spring elements and said trampoline mat, in particular said peripheral frame extends between 1 and 10 cm.

In an embodiment, the trampoline mat has a circumference smaller than an inner circumference of said peripheral frame and is positioned in said frame with said spring elements running from said trampoline mat circumference to said inner circumference of said peripheral frame.

In an embodiment, the spacer comprises a series of spacer spring elements attached to said frame at various positions about said perimeter and at a height above said spring elements, said spacer spring elements holding a band between said frame and said trampoline mat, said band holding spacer elements.

In an embodiment, the air permeable web comprises a net or gauze.

In an embodiment, the peripheral frame has a peripheral frame upper surface, and the spring elements are attached to the peripheral frame to hold the peripheral frame upper surface above the trampoline mat, in particular to hold a trampoline mat plane P at least 1.5 cm removed from the peripheral frame upper surface.

In an embodiment, the spacer provides a second support at a distance and towards the trampoline mat. In an embodiment, the spacer keeping the protective mat functionally horizontal.

In an embodiment, the air permeable web is connected to said protective mat near said trampoline mat and to a circumference of said trampoline mat.

In an embodiment, the air permeable web is a continuous band about the perimeter of the trampoline mat and having opposite sides, one side fixed to the trampoline mat and one side fixed to the protective mat. This can hermetically seal the springs and allow an air channel.

The term "substantially", such as in "substantially all emission" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

The term "functionally" will be understood by, and be clear to, a person skilled in the art. The term "substantially" as well as "functionally" may also include embodiments with "entirely", "completely", "all", etc. Hence, in embodiments the adjective functionally may also be removed. When used, for instance in "functionally parallel", a skilled person will understand that the adjective "functionally" includes the term substantially as explained above. Functionally in particular is to be understood to include a configuration of features that allows these features to function as if the adjective "functionally" was not present. The term "functionally" is intended to cover variations in the feature to which it refers, and which variations are such that in the functional use of the feature, possibly in combination with other features it relates to in the invention, that combination of features is able to operate or function. For instance, if an antenna is functionally coupled or functionally connected to a communication device, received electromagnetic signals that are receives by the antenna can be used by the communication device. The word "functionally" as for instance used in "functionally parallel" is used to cover exactly parallel, but also the embodiments that are covered by the word "substantially" explained above. For instance, "functionally parallel" relates to embodiments that in operation function as if the parts are for instance parallel. This covers embodiments for which it is clear to a skilled person that it operates within its intended field of use as if it were parallel.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices or apparatus herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention further applies to an apparatus or device comprising one or more of the characterising features described in the description and/or shown in the attached drawings. The invention further pertains to a method or process comprising one or more of the characterising features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale

DESCRIPTION OF PREFERRED EMBODIMENTS

Figure 1:
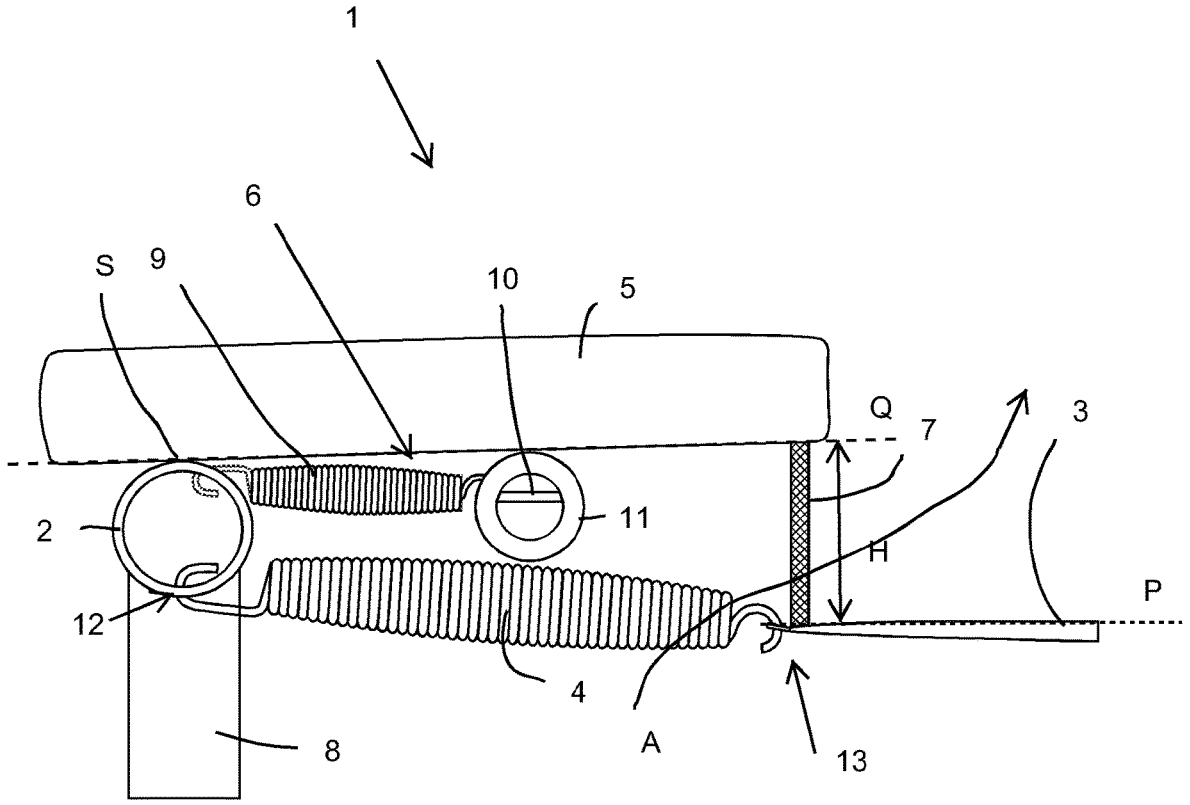
FIG. 1 schematically depicts a cross section through a trampoline side.
Figure 2:
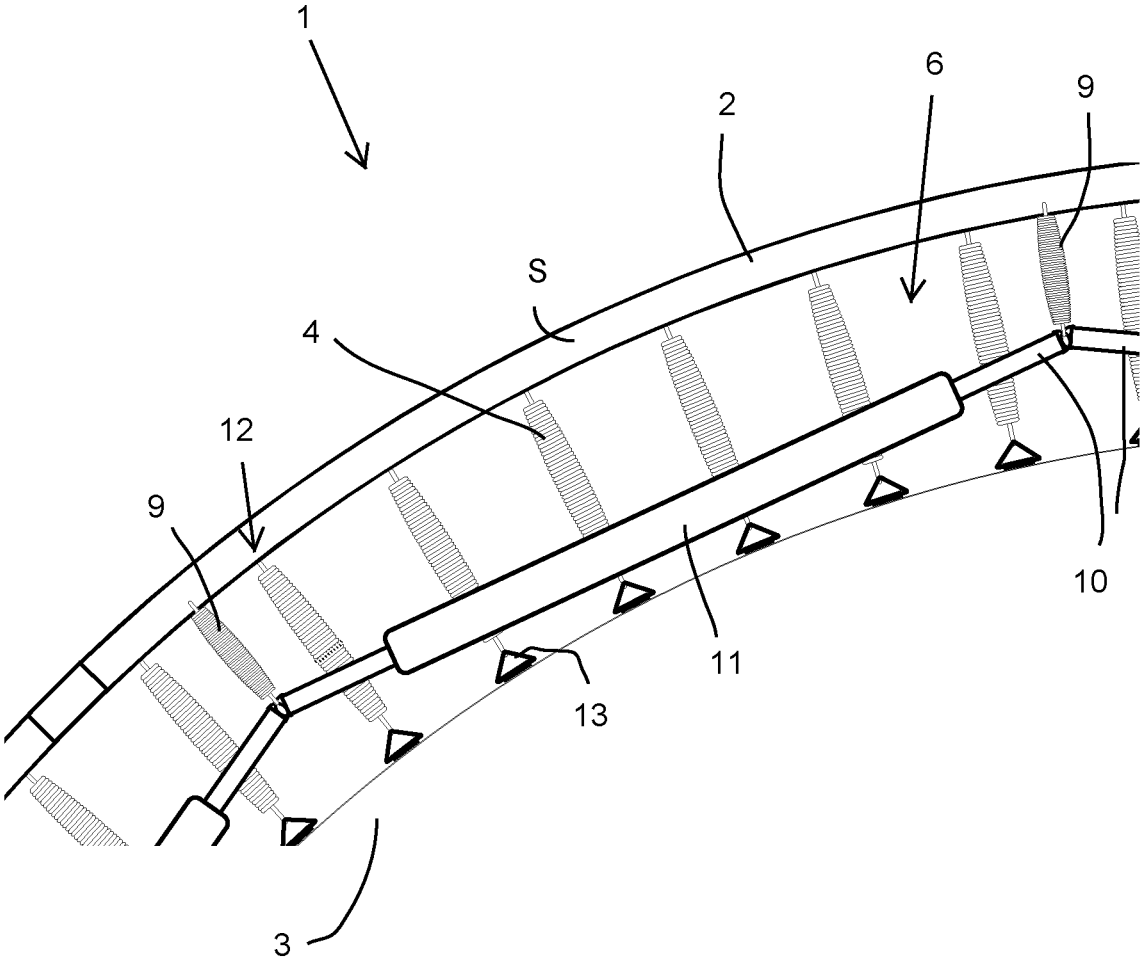
FIG. 2 schematically shows a top view of part of a trampoline with a protective mat removed.

FIG. 1 schematically depicts a cross section through one side of a trampoline 1. In FIG. 2, part of a top view of the trampoline of FIG. 1 is depicted. Usually, such a trampoline 1 has a support frame 8 holding the further construction above a surface. A trampoline can stand free, but can also be placed in an excavated hole in the ground, thus forming an in-ground trampoline 1.

As mentioned above, a trampoline can be rectangular, rectangular with rounded corners, oval, elliptic and round or circular. In many cases, trampoline 1 has a circular or round circumference.

The current trampoline 1 has a peripheral frame 2, often a round tube. This peripheral frame 2 here has the support frame 8 supporting the peripheral frame 2 at one side, which in use is the lower side. The trampoline 1 has a trampoline mat 3 which is held centrally in said peripheral frame 2 via a series of spring elements 4. Here the spring elements 4 are coil springs. These spring elements 4 with on end at the peripheral frame, and at the other end holding the trampoline mat 3, here using a trampoline mat attachment 13. The spring elements are at their one end attached at a lower end of the peripheral frame 2. In the current embodiment, the spring elements 4 hold the trampoline mat 3 below the peripheral frame 2.

A protective mat 5 is usually provided to cover the spring elements 4 to prevent users coming into contact with the spring elements 4. At one end, the protective mat 5 rests on the upper side, opposite the side coupled to the support frame 8, of the peripheral frame 2. In known trampolines, usually the trampoline mat 3 is held higher and the opposite end of the protective mat 5 rests on the trampoline mat 3.

In the current embodiment, the opposite end of the protective mat is held at a height H above the trampoline mat 3. This height H will be at least 2 cm. Usually, it is at least 5 cm. In order to not interfere with jumping users, the height H will be less than 15 cm. In most uses, height H will be less than 10 cm. This will create an air channel, the arrow A in FIG. 1 showing the air flow. In order to prevent parts of a user from accidentally coming into contact with the spring elements 4, here an air-permeable web, usually a gauze or net connects the opposite end of the protective mat 5 and the outer circumference of the trampoline mat 3. In FIG. 2, the protective mat 5 is removed in order to show the further trampoline construction.

The raising of the end of the trampoline mat 3 creates an air channel that allows air that is pushed away from underneath the trampoline mat 3 when a person jumps on it to escape. In particular when the trampoline is for instance of the in-ground type, this may dampen the trampoline mat 3, Furthermore, it may cause the protective mat 5 to clack.

In the current embodiment, the spacer element or spacer 6 that raised the protective mat 5 comprises a spacer part 11 that is held between the spring elements 4 and the protective mat 5. Usually, the spacer part 11 comprises one or more foam elements, here one or more foam tubes.

The spacer part or spacer parts are kept in place by a spacer band 10 which, as can be seen best in FIG. 2, runs between the peripheral frame 2 and the outer circumference or perimeter of the trampoline mat 3. The spacer band runs over and above the spring elements 4. The spacer band 10 in turn is held in place by a series of spacer spring elements 9. These spacer springs 9 pull the spacer band 10 towards the peripheral frame 2. These spacer springs 9 are attached to the peripheral frame 2 above the spring elements 4. In this way, it keeps the spacer band above the spring elements 4.

The different parts and orientation can also be described starting from a trampoline mat plane P that is defined by the trampoline mat 3. In the current embodiments, the trampoline mat 3 comprises a circumference or perimeter. At this (outer) perimeter, spring elements 4 are attached. The trampoline 1 further comprises a peripheral frame 2 for holding the spring elements 4. The peripheral frame has a peripheral frame upper surface S. The spring elements 2 are attached to the peripheral frame in such a way that the peripheral frame upper surface S is above the trampoline mat plane P. In an embodiment, the peripheral frame 2 is above the trampoline mat plane P. In an embodiment, the trampoline mat plane P is at least 1.5 cm removed from the peripheral frame upper surface S. In this way, the protective mat or safety pad can be raised above the trampoline mat plane P such that it is substantially horizontal while an end has a distance or height H from the trampoline mat 3, creating the air channel for allowing air flow A.

The peripheral frame upper surface S provides one support for the protective mat 5, and the spacer part 11 provides a second support at a distance and towards the trampoline mat 3. This for instance keeps the protective mat 5 or safety pad almost horizontal. The spacer spring elements 9 keep the spacer parts 11 with an upper surface defining a spacer plane Q substantially parallel to the trampoline mat plane P at a height H.

It will also be clear that the above description and drawings are included to illustrate some embodiments of the invention, and not to limit the scope of protection. Starting from this disclosure, many more embodiments will be evident to a skilled person. These embodiments are within the scope of protection and the essence of this invention and are obvious combinations of prior art techniques and the disclosure of this patent.

REFERENCE NUMBERS

1 trampoline
2 peripheral frame
3 trampoline mat
4 spring element
5 protective mat
6 spacer element
7 air permeable web
8 support frame
9 spacer spring element
10 spacer band
11 spacer part
12 spring element attachment
13 trampoline mat attachment
H air channel height
A air flow
S peripheral frame upper surface
P trampoline mat plane
Q spacer plane

The invention claimed is:

1. A trampoline comprising a peripheral frame, a trampoline mat attached to said peripheral frame via a series of spring elements, and a protective mat for covering said series of spring elements, wherein said trampoline comprises a spacer attached to said peripheral frame above said series of spring elements and below said protective mat for holding said protective mat a spacer height above said series of spring elements, and an air permeable web connecting said protective mat and said trampoline mat, wherein said trampoline mat has a circumference smaller than an inner circumference of said peripheral frame and is positioned in said peripheral frame with said series of spring elements running from said trampoline mat circumference to said inner circumference of said peripheral frame, wherein said spacer comprises a series of spacer spring elements attached to said peripheral frame at various positions about a perimeter and at a height above said series of spring elements, said series of spacer spring elements holding a band between said peripheral frame and said trampoline mat, a band holding spacer elements.

2. The trampoline of claim 1, wherein the peripheral frame has a peripheral frame upper surface, and the series of spring elements are attached to the peripheral frame to hold the peripheral frame upper surface above the trampoline mat.

3. The trampoline of claim 2, wherein the spacer provides a second support at a distance and towards the trampoline mat, in particular keeping the protective mat functionally horizontal.

4. The trampoline of claim 2, wherein said series of spring elements hold a trampoline mat plane at least 1.5 cm removed from the peripheral frame upper surface.

5. The trampoline of claim 1, wherein said trampoline is an in-ground trampoline.

6. The trampoline of claim 1, wherein said peripheral frame extends above said series of spring elements and said trampoline mat.

7. The trampoline of claim 1, wherein said air permeable web comprises a net or gauze.

8. The trampoline of claim 1, wherein the air permeable web is connected to said protective mat near said trampoline mat and is connected to a circumference or perimeter of said trampoline mat.

9. The trampoline of claim 1, wherein the air permeable web is a continuous band about the perimeter of the trampoline mat and having opposite sides, one side fixed to the trampoline mat and one side fixed to the protective mat.

10. The trampoline of claim 1, wherein said peripheral frame extends between 1 and 10 cm.

* * * * *